United States Patent [19]

Hatcher

[11] 4,430,852

[45] Feb. 14, 1984

[54] POLYOLEFIN PRODUCTS AND METHODS OF MAKING

[75] Inventor: Charles S. Hatcher, Greenville, S.C.

[73] Assignee: Phillips Petroleum Company, Bartlesville, Okla.

[21] Appl. No.: 394,088

[22] Filed: Jul. 1, 1982

Related U.S. Application Data

[63] Continuation of Ser. No. 93,339, Nov. 13, 1979, abandoned.

[51] Int. Cl.[3] ..... D01D 5/22; D02G 3/00

[52] U.S. Cl. ..... 57/247; 57/282; 57/288; 264/176 F; 428/364

[58] Field of Search ..... 57/243, 246, 247, 255, 57/282, 284, 285, 287–289; 264/103, 176 F, 178 F; 428/364

[56] References Cited

U.S. PATENT DOCUMENTS

| | | | |
|---|---|---|---|
| 3,025,689 | 3/1962 | Beghelli | 57/243 X |
| 3,233,023 | 2/1966 | Benson | 264/176 F |
| 3,262,257 | 7/1966 | Martin | 428/364 X |
| 3,323,190 | 6/1967 | Boltniew | 57/243 X |
| 3,705,227 | 12/1972 | Fintel et al. | 264/176 F |
| 3,752,457 | 8/1973 | Parmeggiani et al. | 264/176 F X |

FOREIGN PATENT DOCUMENTS 827409 2/1960 United Kingdom .

*Primary Examiner*—Donald Watkins

[57] ABSTRACT

A process for making filament yarn products is disclosed in which polypropylene, having a molecular weight distribution of less than about 7 and a melt index between about 20 and about 60 is melt spun to produce an as-spun product or additionally interlaced before take-up, twist-drawn, heat set, draw-textured by false-twisting, simultaneously draw-textured, sequentially draw-textured, draw-twisted, draw-Taslan textured, stuffer box crimped and cut into staple fibers, or a plurality of yarns are simultaneously draw-textured by false-twisting while reversing the direction of twist of alternate yarns and thereafter interlacing. Products of improved tenacity, improved birefringence and low elongation are produced.

53 Claims, 11 Drawing Figures

POLYOLEFIN PRODUCTS AND METHODS OF MAKING

This is a continuation of application Ser. No. 093,339 filed Nov. 13, 1979, now abandoned.

BACKGROUND OF THE INVENTION

The present invention relates to a process for making fibrous polyolefin products by melt spinning and products thereof.

While fibrous polyolefins, particularly polypropylene, have been found to possess certain characteristics superior to other synthetic fibrous materials, it is generally recognized that fibrous polyolefins have peculiarities not possessed by other synthetic fibers, which often limit the processability of such materials and limit the end uses to which the products can be applied. For example, the processability limitations result in relatively low extrusion, spinning and wind-up speeds. Often high breakout rates are experienced and further processing of the spun fibers is limited, to the extent that inconsistent texture, broken filaments, lack of color control and difficult in knitting and weaving are often encountered. The products produced by melt spinning polyolefins also have relatively high spun denier, low tenacity, low birefringence, high elongation, high boiling water shrinkage, low modulus of elasticity, as well as other limitations which limit the uses to which the fibrous materials can be applied. It is also recognized that polyolefin fibers cannot generally be utilized in their as-spun state, i.e., with little or no further processing.

It is therefore an object of the present invention to provide an improved process for producing fibrous polyolefin products which overcomes the above-mentioned and other disadvantages of prior art processes and improved fibrous polyolefin products which overcome the above-mentioned and other disadvantages of prior art products. Another object of the present inventoion is to provide a process for producing melt spun, fibrous polyolefin products and fibrous polyolefin products which can be utilized with little or no additional processing. Another object of the present invention is to provide an improved process for producing fibrous polyolefin products which can be carried out at relatively high speeds, particularly higher speeds of extrusion, spinning and wind-up. Another and further object of the present invention is to provide an improved process for producing fibrous polyolefin products which result in products of a low spun denier with consequent lower draw ratios and improved products thereof. Yet another object of the present invention is to provide an improved process for producing fibrous polyolefin products of improved processability, particularly reduced breakout, higher draw ratios, higher and more constant twist levels during false twist texturing, better ease of handling in knitting, weaving, etc., improved color control and improved products thereof. A still further object of the present invention is to provide fibrous polypropylene products having a low spun denier, high tenacity, high birefringence, low elongation, low boiling water shrinkage, high modulus of elasticity and/or high break strength. A still further object of the present invention is to provide fibrous polyolefin products of improved coherency and/or bulkiness. These and other objects of the present invention will be apparent from the following description.

SUMMARY OF THE INVENTION

In accordance with the present invention, novel polyolefin filament products are produced by melt spinning a polyolefin having a molecular weight distribution of less than about 7 (a MW/MN ratio determined by gel permeation chromatography) and a melt flow of between about 20 and about 60 which are useful in their as-spun condition without further processing and have high tenacity, high birefringence and low elongation. In other aspects, the novel products can be converted to other useful products by one or more additional processing steps, including improving the coherency and/or bulkiness by heat setting, texturing, jet texturing such as using a Taslan jet, plying, entangling, and cutting into staple. Still another aspect of the process includes drawing the melt spun fibers, twist-drawing, draw-texturing, draw-twisting, draw-winding, and/or draw-entangling.

DETAILED DESCRIPTION

The process of the present invention comprises producing polyolefin, particularly polypropylene, filament products by melt spinning a polypropylene having a molecular weight distribution of less than about 7 and a melt flow between about 20 and about 60.

The term "molecular weight distribution", as utilized herein, refers to the ratio of the weight average molecular weight to the number average molecular weight. The term "melt flow", as utilized herein, refers to the weight in grams of the polymer which can be extruded within a particular time under a constant dead weight load at a given temperature as determined by ASTM-D-1238, Condition "L". The term "as-spun" as used herein, refers to the filament products of the invention in their condition when taken up on the first wind up package after having been melt spun. Various terms have been used in the art to designate treatments of a plurality of collected filaments or a yarn and a plurality of yarns to improve the coherency of the filaments and/or improve the bulk of the yarn. A process in which the yarn or yarns are heated, twisted, cooled and then untwisted is generally referred to as "false-twist texturing" or simply "texturing". This terminology is almost universally accepted and will be utilized as above defined in the present application. By contrast, where a yarn or yarns is twisted but not subsequently untwisted, the universally accepted terms which will be used herein are "true twist" or simply "twist". Some confusion exists however in the terms used to describe other such treatments, particularly where the yarn or yarns are subjected to a jet or jets of air under pressure. In the latter instance, the results produced and the terminology applied depends upon the condition of treatment, such as air pressure, the direction of the air jet relative to the path of yarn travel and the relative tension being applied to the yarn during treatment. The term "Taslan texturing" (Taslan is a trademark of E. I. duPont de Nemours and Company) as used herein is meant to refer to a process and product in which a jet or jets of air are directed against the yarn, usually in the direction of travel of the yarn, forming a turbulent region, the speed or tension on the yarn is greater at the entrance to the jet than at the exit (net overfeed) and the filaments of the resultant product have a multitude of ring-like loops, coils and whorls at random intervals along their lengths. The term "entangling" or "intermingling", sometimes called "interlacing" as used herein, refers to a process and product in which a jet or jets of air are directed against the yarn or yarns, usually at a 90° angle to the yarn path, the speed or tension on the yarn is substantially the same at the entrance and exit of the intermingler and the resultant product has a high degree of intermingling or entangling of the filaments but is substantially free of loops, coils and whorls. Finally, "plying" is used to refer to a process and products in which two or more yarns are formed into a single yarn by twisting or intermingling in a jet. The terms "cold draw" or simply "draw" refers to a process in which filaments or yarns are drawn or stretched (with or without heat and during or after windup) after the spun filaments have solidified as opposed to drawing which occurs during the spinning of the filaments and before the solidification thereof. Stretching which occurs while spinning and before the filaments have solidified will be referred to as "melt drawing" and the products thereof as "partially oriented" products. The term "finish" indicates a liquid composition applied to the yarn during melt spinning that acts as a lubricant and imparts desirable characteristics to the yarn.

In a preferred embodiment, melt spinning is carried out at a take-up speed within the range of about 1200 to 5000 meters per minute and still more preferably between about 1500 and 4000 meters per minute.

In another embodiment unique products are obtained by melt spinning, carried out at take-up speeds in the range of 800–1200 meters per minute, draw-texturing at least three of the yarns as spun with the direction of twist for two yarns being different from the third, then plying the yarns in an interlacing jet. The product of this embodiment is simultaneously draw-textured at a draw ratio of 4.0 to 1 to 2.0 to 1.

The products produced in accordance with the present invention have a number of advantageous characteristics not heretofore present in melt spun polyolefins. Specifically, the polyolefin filaments have a spun denier below about 25 per filament. In the as-spun condition, the products have a high birefringence, usually in excess of about 0.015. The products also have low elongations between about 100 and 350 percent as measured by ASTM Method 2256 and preferably in the range of about 100 to 250 percent. In the alternative, drawn filament materials can be produced having conventional spun deniers but which are drawn at lower draw ratios. The as-spun products also have a high tenacity above about 2.4 grams/denier and, to the extent that the filament materials are further processed by drawing or twisting, higher cold draw ratios may be utilized. For example, draw ratios within the range of 2.0/1 to 4.0/1 can be utilized.

While the polyolefin filament products of the present invention are useful in their as-spun condition, these products can be further processed by a wide variety of treatments to form the same into yarns of desired characteristics for use in a variety of textile products, such as woven or nonwoven material, tufted products and the like. For example, the products may be heat set and entangled. Such processes to improve the coherency may be performed during the spinning operation (prior to winding up) or after collecting the fibers and winding the same. Excellent products can also be produced by crimping, such as steam crimping, or stuffer box crimping and cutting the crimped materials into staple. The as-spun products of the present invention can also be further improved by subjecting the same to further processing which includes cold drawing. Such processing can involve spin-drawing, twist-drawing, false-twist texturing, draw-texturing, draw-twisting, and draw-Taslan texturing.

The preferred polyolefin, fiber-forming materials for use in accordance with the present invention are homopolymers of polypropylene. However, a fiber-forming resin comprising a copolymer of propylene with a small amount (less than 15%) of an olefinic monomer, such as ethylene, butene or a diene monomer, such as butadiene, isoprene, etc, may be employed. If desired, a fiber-forming resin blend composed of a predominant amount of a propylene polymer and a small amount (less than 15%) of at least one polymer of the above mentioned olefinic or diene compound may be used. Therefore the term "polypropylene" as used herein is intended to include the propylene homopolymers, polymer blends and copolymers mentioned above. As for the fiber forming resin, it is preferable to employ a crystalline polypropylene homopolymer having a molecular weight distribution of less than about 7 and a melt flow of between about 20 and about 60.

The present invention will be more readily understood by reference to the drawings.

Figure 1:
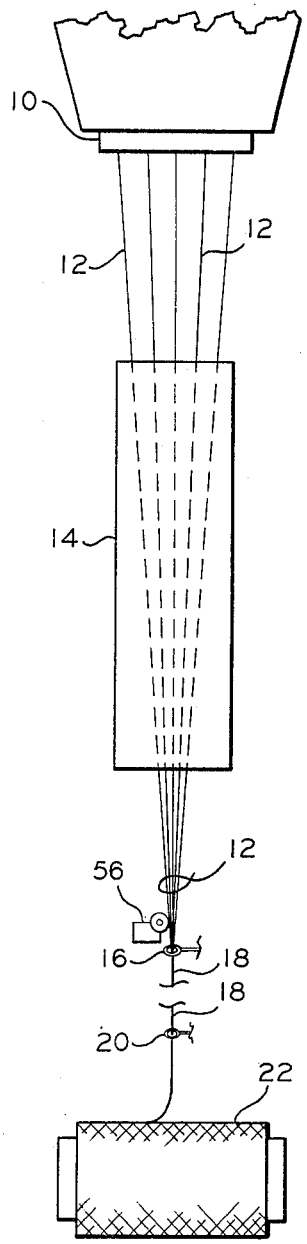
FIG. 1 schematically illustrates a melt-spinning process for producing an as-spun product.

In referring to the drawings it should be recognized that the spatial relationships of the elements are not necessarily those which would be utilized in a commercial operation and that certain elements and items of equipment have been enlarged with respect to other elements or items of equipment so that the character thereof can be illustrated in somewhat greater detail.

In accordance with FIG. 1, which illustrates one embodiment of the present invention, a plurality of filaments are melt spun from spinneret 10. The filaments 12 then pass through a quench zone 14 where they are cooled by blowing air therethrough. Applicator 56 applies a finish to the yarn. The filaments 12 then pass through converging guide 16 where they are collected to form a yarn 18. Converging guide 16, as will appear hereinafter, may be a pigtail type eyelet, a slotted roller, or any conventional converging or collecting means. The yarn 18 then passes to a conventional winder wherein traversing guide 20 moves laterally to wind the yarn and form a package 22. The drawing that occurs between the spinneret 10 and the take-up package 22 provides partial orientation of the yarn. As has been pointed out previously, filaments and yarn made in accordance with the present invention are useful for various purposes in their as-spun condition with no subsequent processing or treatment other than that shown in FIG. 1.

Figure 2:
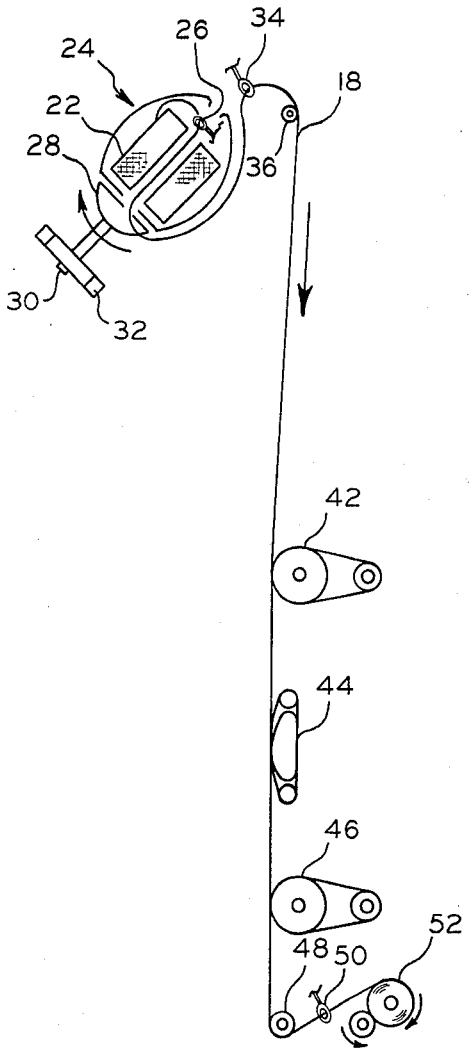
FIG. 2 schematically illustrates an embodiment in which a yarn is twist-drawn.

FIG. 2 of the drawings shows another embodiment of the present invention wherein yarn, produced in accordance with FIG. 1, is further processed by twist-drawing. In accordance with FIG. 2, a yarn package 22, such as that produced in FIG. 1 is mounted on twister 24. The yarn is drawn off package 22 and passes through pretension gate 26, thence through the core of package 22 and through rotatable spindle 28. Rotatable spindle 28 is attached to shaft 30 which is driven by belt 32. Twister 24 is referred to as a "two-for-one twister" in that it inserts two turns of true twist for each rotation of spindle 28. The twisted yarn then passes through guide elements 34 and 36. The yarn is wrapped several times about feed rolls 42 and several times about draw rolls 46 which operate at speed greater than rolls 42 and thus draw or stretch the yarn in the zone between the rolls. Optionally, the drawn yarn can pass over heater 44 to rolls 46 to heat the yarn during drawing, or the rolls 42 and 46 can be heated, eliminating the need for hot plate heater 44. From draw rolls 46 the yarn passes over stationary guide 48 and thence through traverse guide 50 of a winder, which ultimately forms package 52. A more detailed description of the operation shown in FIG. 2 can be found in U.S. Pat. No. 3,795,961.

Figure 3:
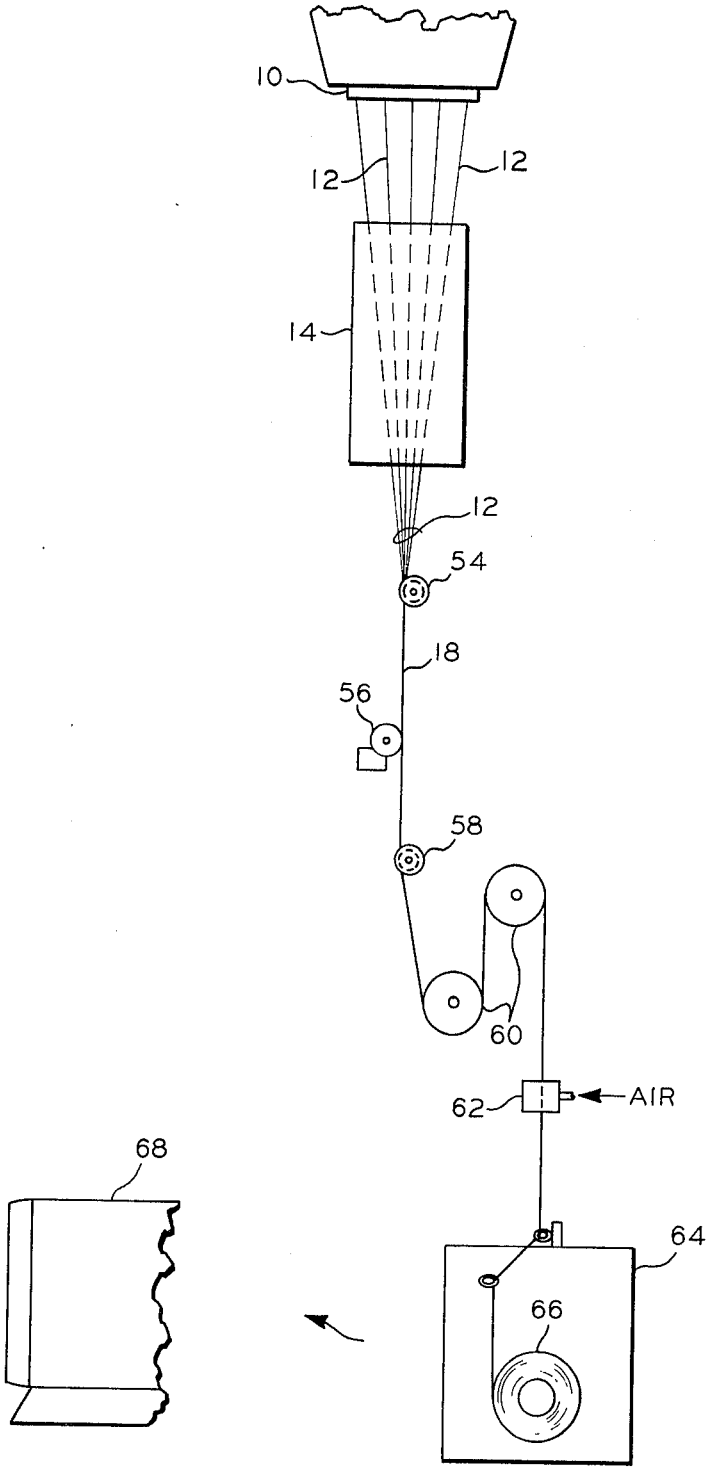
FIG. 3 schematically illustrates several techniques for improving the coherency and/or bulking a yarn.

FIG. 3 illustrates a modification of the present invention in which one or more treatments are given to the as-spun yarn 18 to improve the coherency and/or bulkiness of the filaments of the yarn. These treatments include entangling the yarn and/or heat setting the yarn. Specifically, the plurality of filaments 12 pass over ceramic guide 54 where they are collected or converged, in the same manner as in eyelet-type converging guide 16 of FIG. 1, to form the yarn 18. The yarn 18 may then be passed over applicator 56 which applies a finish to the yarn and thereby improves the coherency of the filaments of the yarn and acts as a lubricant during processing. Finish applicator 56, as shown in the dawing, is what is known as a "kiss roll". The yarn 18 then passes over ceramic guide 58 and thence to godet rolls 60. From godet rolls 60 the yarn passes through a jet type entangler 62. Entangler 62 may be of the type shown and described in U.S. Pat. No. 2,783,609. In this type of entangler the filaments of the yarn are intermingled, but have no significant coils, loops or whorls, by a high velocity air jet. This treatment improves the coherency of the filaments of the yarn for windup. The entangled yarn then passes to winder 64 where it is wound on package 66. It should be recognized at this point that the finish applicator 56 and entangler 62 may be used alone or in combination and that either or both may be placed in any of a number of different positions between converging guide 54 and winder 64. In an alternative form of improving the coherency of the filaments of the yarn, the yarn package 66 may be placed in an autoclave 68 where the yarn is heat set at about 120° C. The heat-set yarn also has improved coherency of the filaments when used alone or it may be used in combination with the application of a finish and/or entangling.

Figure 4:
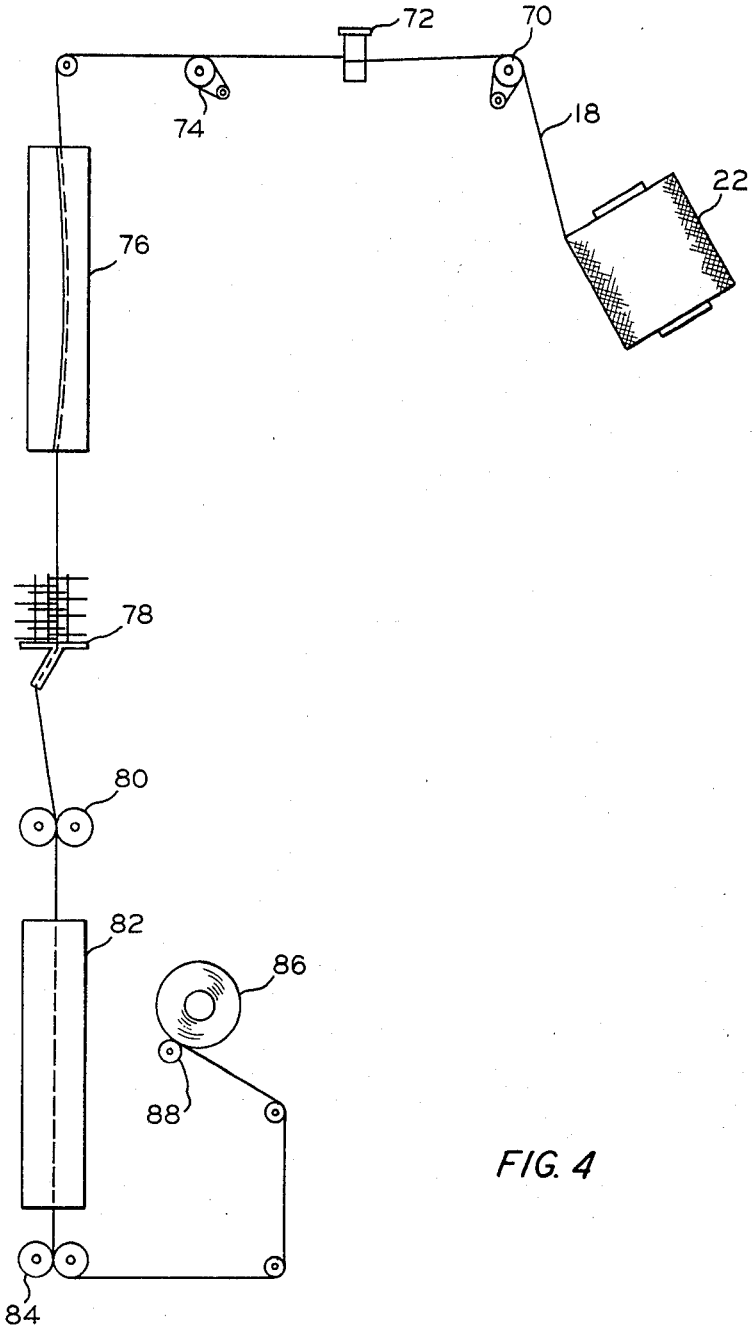
FIG. 4 schematically illustrates an embodiment in which a yarn is sequentially draw-textured.

FIG. 4 of the drawings illustrates yet another embodiment of the present invention wherein the yarn 18, as produced in FIG. 1, is subjected to a subsequent treatment involving draw-texturing. In accordance with the embodiment of FIG. 4, the yarn 18 passes around input rolls 70 thence about hot pin 72 or across an appropriate hot plate and finally around draw rolls 74 which are rotated at a speed greater than input rolls 70 to thereby stretch or draw the yarn. The drawn yarn then passes over a plate-type first stage heater 76. From heater 76 the yarn passes through a disc-type, false-twist spindle 78. From disc-type false-twist spindle 78 the yarn passes between intermediate rolls 80 and thence to second stage heater 82. From second stage heater 82 the yarn passes through output rolls 84 and thence to takeup package 86 which is driven by package drive roll 88. It should be noted that a conventional false twist spindle could be substituted for the disc type illustrated here and in the other embodiments.

Figure 5:
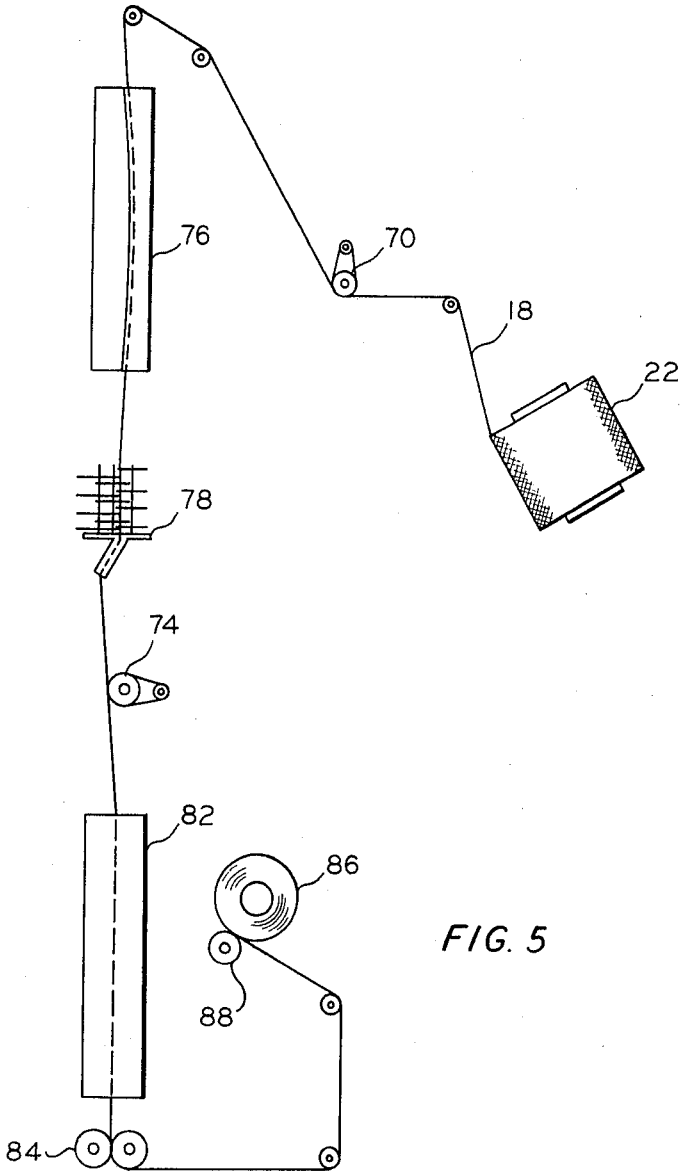
FIG. 5 schematically illustrates an embodiment in which a yarn is simultaneously draw-textured.

FIG. 5 of the drawings illustrates an alternative form of the method of FIG. 4 which is referred to in the art as simultaneous draw-texturing. It is to be observed that the process of FIG. 5 differs from that of FIG. 4 only to the extent that hot pin 72 and rolls 80 are eliminated and the yarn is heated and drawn simultaneously with the insertion of false twist to the yarn by positioning draw rolls 74 downstream of disc-type false-twist spindle 78.

Figure 6:
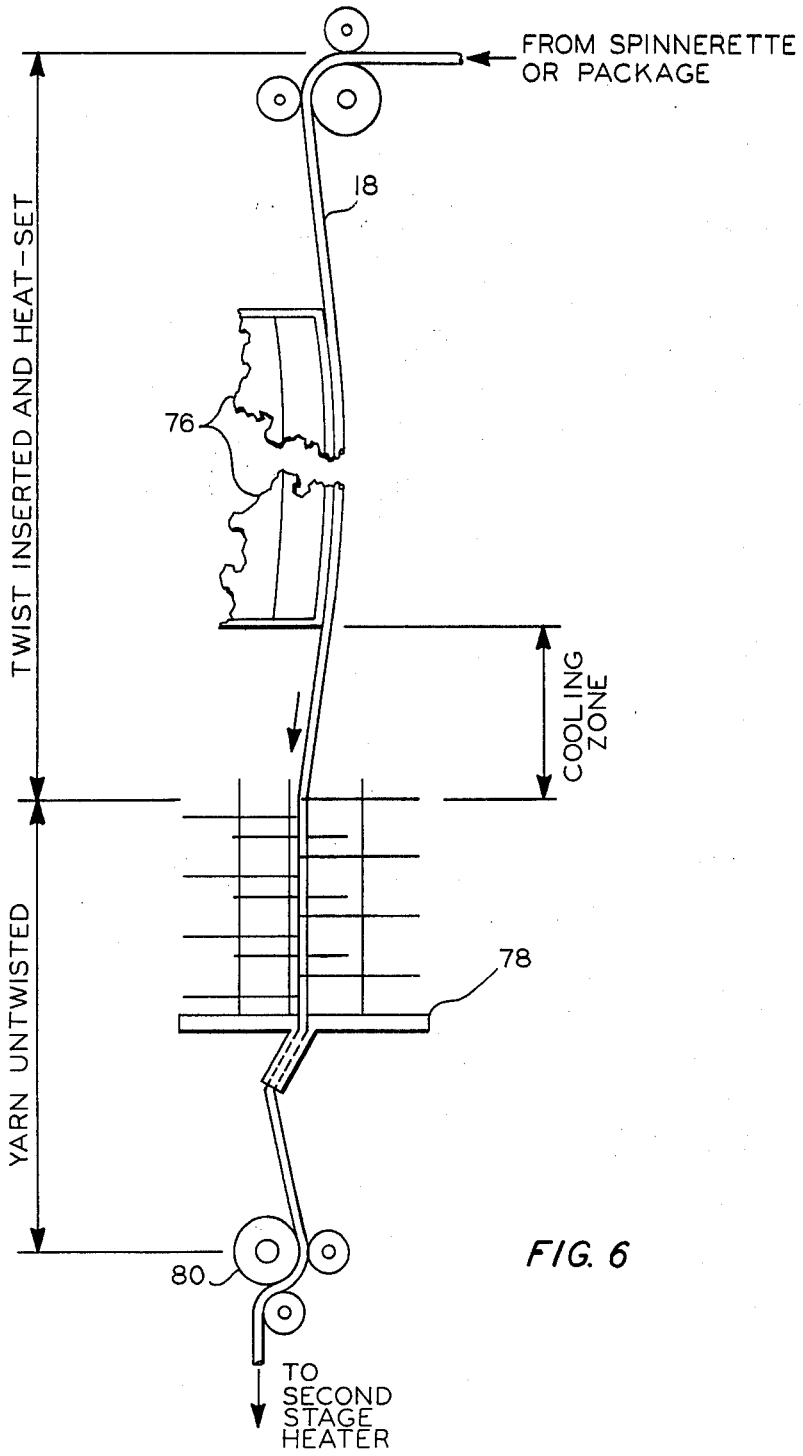
FIG. 6 schematically illustrates in slightly greater detail a false-twist texturing operation.

FIG. 6 of the drawings, although schematic in nature, shows in somewhat greater detail the false twist texturing operation and graphically illustrates why it is referred to as "friction" false twisting. Specifically, the yarn 18 passes over first stage heater 76 and thence to disc-type false-twist spindle 78, illustrated as an array of rotating friction discs that impart false twist to the yarn. In the zone containing first stage heater 76 to disc-type false-twist spindle 78, twist is inserted and heat set in the yarn. From the lower end of heater 76 to disc-type false twist spindle 78 a cooling zone makes up the lower or downstream portion of the twist-heat-set zone. After passing through disc-type false twist spindle 78 and thence to intermediate feed rolls 80, the yarn is untwisted. Since the previous treatment twisted the yarn and heat set this twist the untwisting will not straighten the elements or filaments but instead results in a yarn whose coherency and bulkiness are improved by the false twisting.

Figure 7:
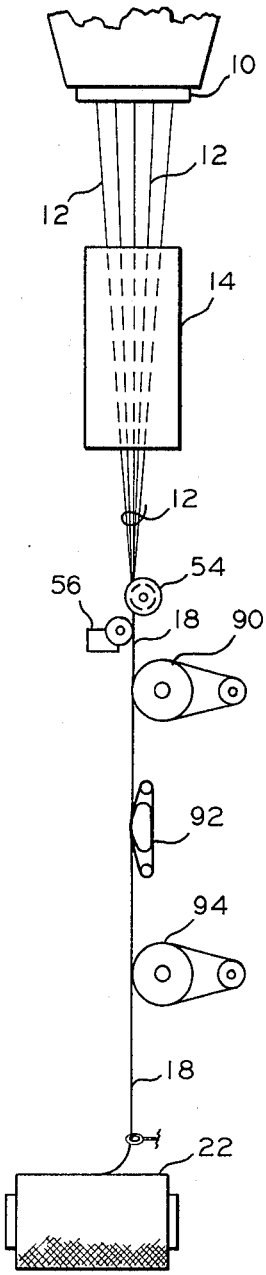
FIG. 7 schematically illustrates a spin-drawn embodiment.

FIG. 7 of the drawings illustrates yet another embodiment of the present invention wherein a yarn is formed by a simple spin-draw operation. In accordance with FIG. 7 the yarn 18, formed by passage over converging guide 54, passes over feed rolls 90, thence to heater 92 and draw rolls 94, operating at a higher speed than rolls 90.

Figure 8:
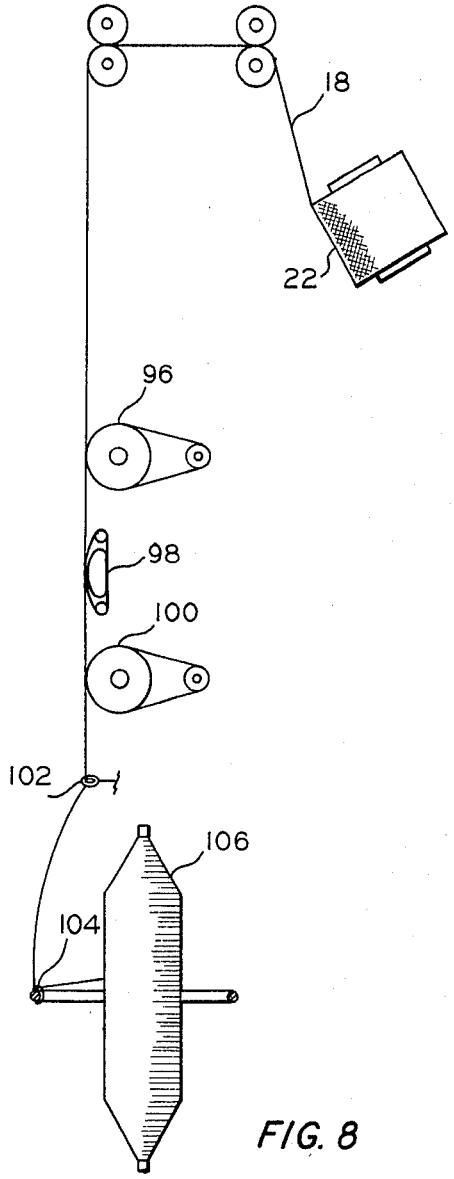
FIG. 8 schematically illustrates an embodiment in which a yarn is draw-twisted.

FIG. 8 of the drawings shows yet another after-treatment to which the as-spun yarn of FIG. 1 can be subjected. Specifically, the operation of FIG. 8 is what is generally referred to as draw-twist. In accordance with FIG. 8 the yarn 18 from package 22 passes over feed rolls 96, over heater 98 and thence over draw rolls 100. The latter, of course, are operated at a speed higher than the speed of feed rolls 96 to thereby stretch or draw the yarn. The drawn yarn then passes through guide 102 and thence to rotatable flyer 104 which winds the yarn up on pirn 106. As flyer 104 rotates, it inserts true twist in the yarn. It should be recognized at this point that a spin-drawn yarn, prepared in accordance with FIG. 7, or a draw-twisted yarn prepared in accordance with FIG. 8 may thereafter be subjected to a false twist-texturing operation, as performed in the double heater, false-twist texturing machines illustrated in FIGS. 5 and 6 of the drawings.

Figure 9:
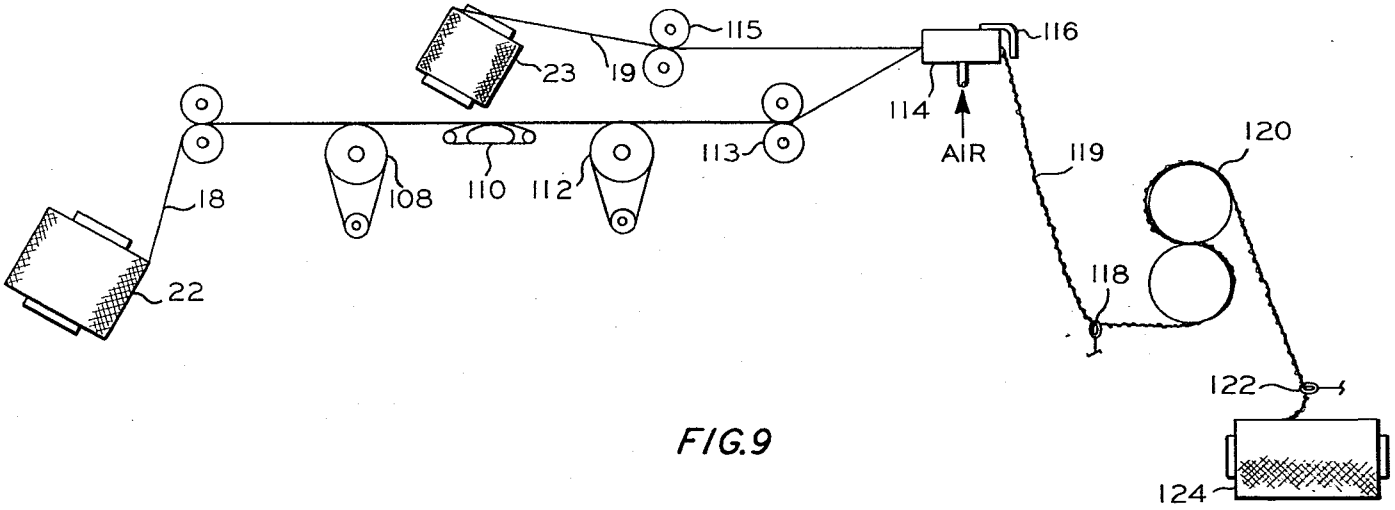
FIG. 9 schematically illustrates an embodiment in which two yarns are draw-Taslan textured.

FIG. 9 illustrates an after treatment of the as-spun yarn produced in FIG. 1 wherein the yarn 18 is drawn-Taslan textured as an effect yarn and combined with a core yarn 19. In accordance with FIG. 9 the yarn 18 from package 22 is passed through a draw zone comprising feed rolls 108, heater 110 and draw rolls 112 and feed rolls 113. From the draw zone the yarn 18 is passed to a Taslan jet 114. Core yarn 19 from package 23 is passed by feed rolls 115 operating at a slower speed than rolls 113 to Taslan jet 114. As previously indicated, the yarns in passing through Taslan jet 114 are subjected to turbulence in a high velocity air stream and separated from the air stream by being jetted against baffle 116 and then turned in a generally perpendicular path. Due to the overfeed of yarn 18, it becomes the effect yarn. Passage through the jet 114 results in the filaments of the yarn forming loops, rings and whorls therein and effecting some intermingling of the filaments. Generally, the yarns are under tension as they enter Taslan jet 114 and as the core and effect yarn 119 exits Taslan jet 114 it is traveling at a reduced speed and this reduction in tension during the turbulence contributes to the formation of the loops, etc. The yarn 119 then passes through guide 118 to takeup rolls 120, thence through traverse guide 122 of a winder and onto a package 124. Taslan jet 114 is of the type well known in the art and will not be further described herein.

Figure 10:
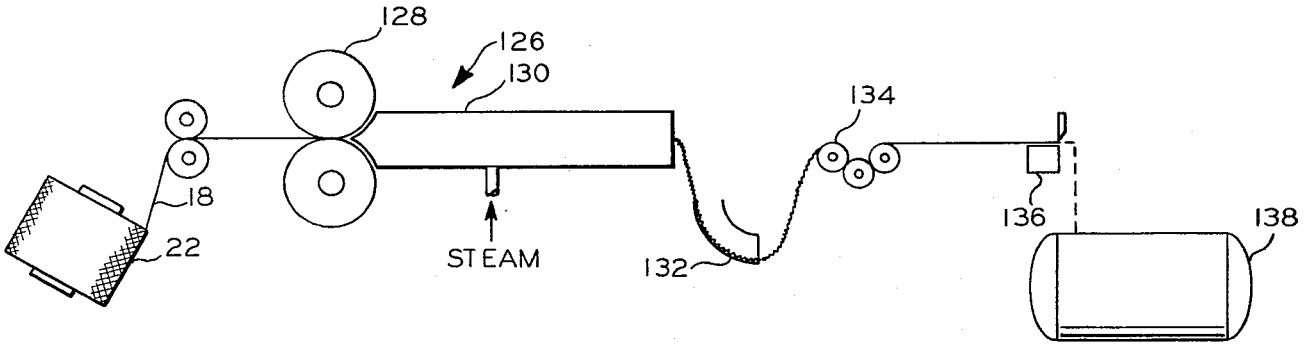
FIG. 10 schematically illustrates an embodiment including crimping and cutting into staple.

The embodiment of the present invention shown in FIG. 10 subjects the yarn 18, produced in accordance with FIG. 1, to a subsequent treatment involving crimping of the yarn and, optionally, cutting the crimped yarn into staple. Specifically, the yarn 18 is fed to crimper 126 which comprises feed rolls 128 and stuffer box 130. The specific crimper shown is a steam crimper and a preferred steam crimper is shown and described in U.S. Pat. No. 3,911,539. From the stuffer box 130 the crimped yarn passes to J-box 132, over tensioning rolls 134 and thence to staple cutter 136. Staple cutter 136 cuts the crimped yarn into short fibers or staple which are then passed to bailer 138. At this point it should be recognized that additional finish may be applied to the yarn prior to passage through crimper 126 and the yarn may be cold drawn prior to the crimping operation.

Figure 11:
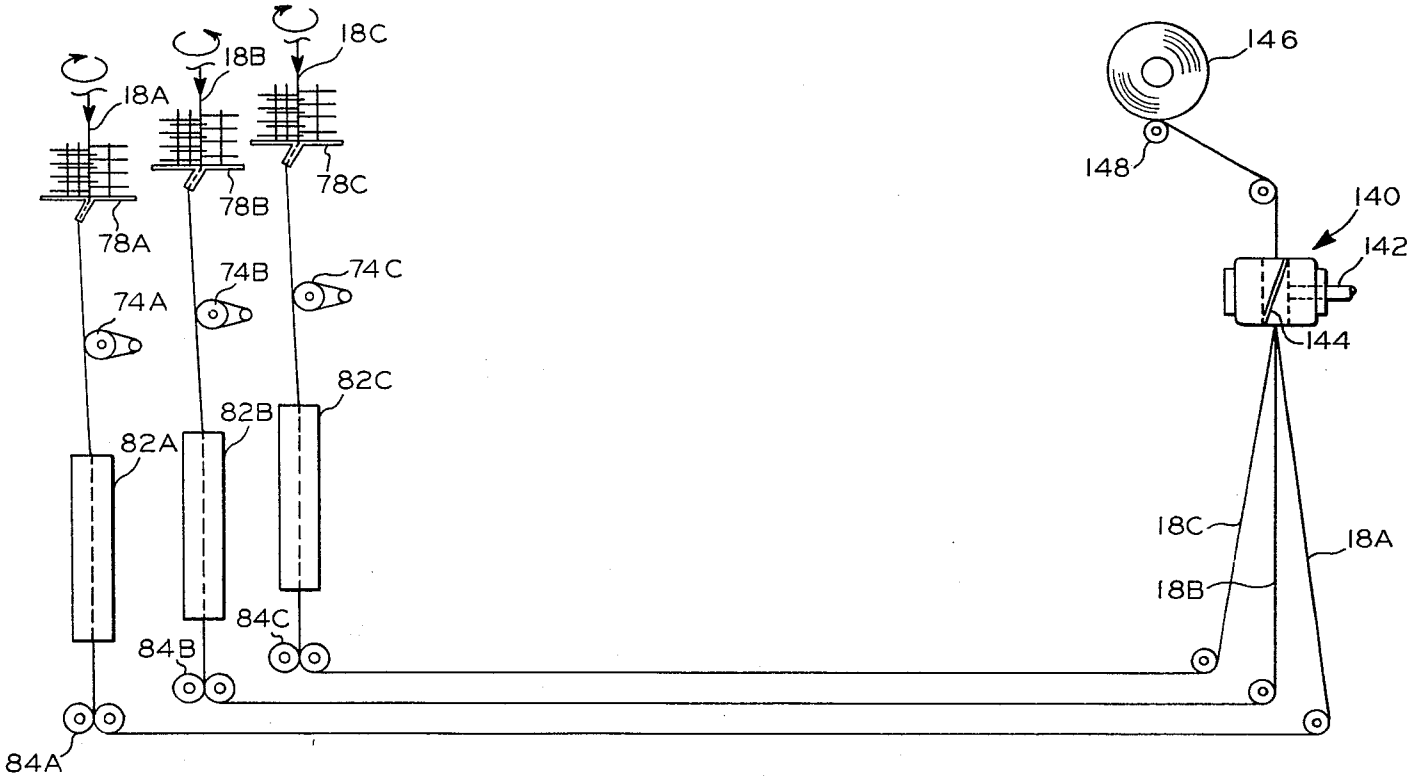
FIG. 11 schematically illustrates an embodiment in which a plurality of yarns are draw-textured and interlaced.

FIG. 11 of the drawings illustrates a novel technique for forming a plied and interlaced yarn from a plurality of draw-textured yarns produced in accordance with the draw-texturing operations illustrated in FIGS. 4, 5 and 6. Preferably, a plurality of yarns are simultaneously draw-textured as illustrated in FIG. 5. Specifically, three separate yarns 18A, 18B and 18C, respectively, are simultaneously draw-textured by passing the same through disc-type false-twist spindles 78A, 78B and 78C, draw rolls 74A, 74B and 74C, second stage heaters 82A, 82B and 82C and output rolls 84A, 84B and 84C. While the draw-texturing devices are shown as offset in FIG. 11, for clarity of illustration only, it is to be understood that units A, B and C would be in side-by-side relationship in actual operation. The draw-textured yarns 18A, 18B and 18C are thereafter passed through an entangling or interlacing device 140 which plies the yarns together. The interlacer 140 is the same type entangler or interlacer as 62, referred to in the description of FIG. 3 for a single yarn. Interlacer 140 generally comprises a tube through which a plurality of yarns are fed. The tube through which the yarns pass is provided with air from an annular plenum zone supplied with air by means of air supply 142. To aid in stringup of the yarns in interlacer 140, the interlacer is provided with a slot 144, which is preferably at an angle so as to aid in retention of the yarns in the yarn tube. The interlaced yarn then is wound up on takeup package 146 driven by package drive roll 148. It has been found in accordance with the present invention that the system of FIG. 11 is particularly useful in the production of a heather-type yarn, in which three different colors of yarn are plied by interlacing. Specifically, it has been found, in accordance with the present invention, that, in a system such as that of FIG. 11, if a plurality of yarns to be interlaced are all twisted in the same direction this results in a high torque being applied to the yarns. However, it was discovered that if alternate ones of the plurality of yarns were false twisted in the opposite direction, this undue torque was essentially eliminated and a heather-type yarn of substantially improved characteristics was produced. This is illustrated in FIG. 11 by the rotational direction arrows applied to false-twist spindles 78A, 78B and 78C. In this particular illustration, where three yarns are interlaced, the middle yarn or 18B would be false twisted in the opposite direction to yarns 18A and 18C. It should be recognized however that more than three yarns could be interlaced, in fact as many as eight could be interlaced. Where more than three yarns are interlaced, as previously indicated, alternate false-twist spindles would be operated in a reverse direction.

The following examples illustrate the nature and advantages of the present invention.

EXAMPLE I

A comparison was made of the as-spun properties of a conventional melt spun polypropylene having a broad Molecular Weight Distribution=12.1 and a low resin Melt Flow=10–12 (Resin A); a polypropylene having a broad Molecular Weight Distribution=12 and a high resin Melt Flow=44, (Resin K), a polypropylene having a broad Molecular Weight Distribution=12 and a low resin Melt Flow=3 (resin L) and a plurality of different resins having narrow Molecular Weight Distributions (4.2 to 7.5) and high resin Melt Flows (21 to 57). The letter designations in Table I indicate the individual resins utilized. Runs 1 to 12, 19, 20, 22 and 25 utilized a 12×48 mil spinnerette with 325 mesh screen. Runs 1 to 12 utilized a spin temperature of 293° C. and runs 19, 20, 22 and 25 a spin temperature of 246° C. Since some difficulties in spinning and quenching were encountered and it appeared desirable to spin resin B at lower spin speeds for comparison runs 13 through 18, 21, 23, 24 and 26 were spun at 254° C. spin temperature through a 32-hole−0.012×0.048 inch spinnerette and utilizing quench air at 80 ft/min. Some difficulties were again experienced at spin speeds above 2400 meters/minute and runs 36 through 43 were spun through a spinnerette with 0.03×0.090 inch holes. Runs 44 through 57 were spun, utilizing a spinnerette having 0.012×0.048 inch holes at a spin temperature of 312° C. Runs 27 through 35 were run at a spin temperature of 250° C., a nominal godet speed (spin speed of 2500 meters/minute) and utilizing quench air at 80 ft/min. A finish herein designated finish C as in Table V was applied to the collected filaments at a rate of 1% by weight and comprised 86.63% Nopcolube 2152P (Diamond Shamrock, Morristown, N.Y.), 13.32% ethoxylated cetyl/stearyl alcohol (25 moles ethylene oxide per molecule) and 0.05% of Givgard DXN (sold by Givaudin Corp. of Clifton, N.J.) an antimicrobial preservation agent. It is to be noted that the melt flow listed in Table I is "melt spun melt flow" or the melt flow as measured after melt spinning. Generally, the resin melt flow of relatively low resin melt flow polymers will differ significantly from the melt spun melt flow but with relatively high resin melt flow polymers the melt spun melt flow will not change appreciably.

TABLE I

| Run Sample | Molecular Weight Distribution | Melt Spun Melt Flow | Spin Speed m/m | lb./hr. Thread-line | Tenacity | Elongation | Boiling Water Shrinkage | 5% Modulus | Birefringence | Denier |
|---|---|---|---|---|---|---|---|---|---|---|
| 1-A | 12.1 | 10.4 | 400 | 1.8 | 1.3 | 711 | 2.2 | | 0.004 | 307 |
| 2-A | 12.1 | 10.4 | 400 | 2.0 | 1.2 | 735 | 1.8 | | 0.004 | 342 |
| 3-A | 12.1 | 10.9 | 400 | 3.7 | 1.3 | 614 | 1.8 | | 0.008 | 315 |
| 4-A | 12.1 | 10.4 | 800 | 4.1 | 1.3 | 647 | 1.6 | | 0.008 | 348 |
| 5-A | 12.1 | 10.4 | 1200 | 5.6 | 1.4 | 632 | 1.6 | | 0.012 | 319 |
| 6-A | 12.1 | 10.4 | 1200 | 6.1 | 1.3 | 537 | 1.8 | | 0.013 | 345 |
| 7-A | 12.1 | 10.4 | 1200 | 5.6 | 1.3 | 572 | 1.8 | | 0.012 | 315 |
| 8-A | 12.1 | 10.4 | 1200 | 6.0 | 1.3 | 551 | 2.2 | | 0.012 | 340 |
| 9-A | 12.1 | 10.4 | 1600 | 7.4 | 1.3 | 575 | 1.8 | | 0.016 | 313 |
| 10-A | 12.1 | 10.4 | 1600 | 8.0 | 1.4 | 534 | 2.0 | | 0.018 | 339 |
| 11-A | 12.1 | 10.4 | 2000 | 9.4 | 1.4 | 548 | 2.0 | | 0.017 | 321 |
| 12-A | 12.1 | 10.4 | 2000 | 10.7 | 1.3 | 549 | 2.2 | | 0.018 | 363 |
| 13-B | 4.2 | 37 | 400 | 2.1 | 1.2 | 698 | 0.2 | 5.1 | 0.007 | 350 |
| 14-B | 4.2 | 37 | 800 | 3.7 | 1.7 | 466 | 1.2 | 6.0 | 0.012 | 312 |
| 15-B | 4.2 | 37 | 1200 | 4.9 | 2.1 | 367 | 0.6 | 7.0 | 0.018 | 276 |
| 16-B | 4.2 | 37 | 1200 | 4.8 | 2.1 | 354 | 0.6 | 6.9 | 0.018 | 270 |
| 17-B | 4.2 | 37 | 1600 | 5.9 | 2.4 | 312 | 1.4 | 8.2 | 0.022 | 250 |
| 18-B | 4.2 | 37 | 2000 | 6.2 | 2.6 | 287 | 2.1 | 9.9 | 0.022 | 212 |
| 19-B | 4.2 | 37 | 2000 | 7.3 | 2.6 | 268 | 2.0 | | 0.022 | 250 |
| 20-B | 4.2 | 37 | 2000 | 8.2 | 2.6 | 273 | 2.0 | | 0.022 | 278 |
| 21-B | 4.2 | 37 | 2400 | 6.4 | 2.8 | 212 | 3.7 | 10.8 | 0.025 | 181 |
| 22-B | 4.2 | 37 | 2600 | 7.7 | 2.9 | 197 | 3.8 | | 0.023 | 201 |
| 23-B | 4.2 | 37 | 2800 | 7.2 | 2.9 | 187 | 3.0 | 13.4 | 0.025 | 174 |
| 24-B | 4.2 | 37 | 3200 | 7.9 | 3.1 | 183 | 3.2 | 15.0 | 0.025 | 167 |
| 25-B | 4.2 | 37 | 3200 | 7.7 | 3.2 | 190 | 4.0 | | 0.023 | 164 |
| 26-B | 4.2 | 37 | 3600 | 8.4 | 3.1 | 175 | 3.1 | 17.6 | 0.025 | 159 |
| 27-C | 5.0 | 21 | 2500 | | 3.0 | 181 | 2.9 | 93* | 0.024 | 180 |
| 28-D | 7.5 | 29 | 2500 | | 2.8 | 197 | 2.9 | 89* | 0.024 | 180 |
| 29-E | 4.26 | 30 | 2500 | | 2.4 | 261 | 2.5 | 109* | 0.022 | 177 |
| 30-F | 4.2 | 50 | 2500 | | 3.1 | 182 | 2.0 | 91* | 0.023 | 175 |
| 31-G | 4.9 | 57 | 2500 | | 2.9 | 201 | 2.0 | 90* | 0.023 | 177 |
| 32-H | 5.3 | 47 | 2500 | | 2.5 | 235 | 2.5 | 99* | 0.022 | 176 |
| 33-I | 5.3 | 49 | 2500 | | 1.8 | 315 | 2.9 | 112* | 0.021 | 176 |
| 34-J | 5.3 | 40 | 2500 | | 2.4 | 251 | 2.5 | 106* | 0.023 | 174 |
| 35-K | 12 | 44 | 2500 | | 1.1 | 564 | 3.1 | 129* | 0.017 | 174 |
| 36-B | 4.2 | 37 | 2400 | 6.4 | 2.8 | 218 | 3.7 | 10.8 | 0.025 | 176 |
| 37-B | 4.2 | 39 | 2800 | 7.2 | 2.9 | 215 | 3.1 | 13.2 | 0.025 | 182 |
| 38-B | 4.2 | 37 | 3200 | 7.9 | 2.8 | 196 | 3.7 | 15.0 | 0.025 | 167 |
| 39-B | 4.2 | 37 | 3600 | 8.5 | 3.0 | 192 | 4.1 | 16.9 | 0.025 | 160 |
| 40-B | 4.2 | 37 | 4000 | 8.6 | 3.0 | 180 | 3.9 | 19.1 | 0.019 | 146 |
| 41-C | 5.0 | 21 | 2400 | 6.5 | 2.9 | 239 | 2.9 | 13.4 | 0.025 | 184 |
| 42-C | 5.0 | 21 | 2800 | 7.2 | 2.7 | 213 | 2.8 | 15.1 | 0.025 | 174 |
| 43-C | 5.0 | 21 | 3200 | 7.4 | 2.6 | 236 | 3.1 | 15.9 | 0.025 | 158 |
| 44-L | 12 | 9–12 | 400 | 2.0 | 1.6 | 610 | 0.2 | 5.7 | 0.007 | 345 |
| 45-L | 12 | 9–12 | 800 | 3.7 | 2.1 | 488 | 1.0 | 8.0 | 0.016 | 317 |
| 46-L | 12 | 9–12 | 1200 | 4.8 | 2.1 | 405 | 1.5 | 12.2 | 0.021 | 271 |
| 47-L | 12 | 9–12 | 1200 | 4.8 | 2.1 | 429 | 1.8 | 11.7 | 0.020 | 272 |
| 48-L | 12 | 9–12 | 1600 | 5.9 | 2.1 | 416 | 1.9 | 12.6 | 0.021 | 250 |
| 49-L | 12 | 9–12 | 2000 | 6.2 | 2.1 | 388 | 1.6 | 14.5 | 0.021 | 212 |
| 50-L | 12 | 9–12 | 2400 | 6.4 | 2.3 | 423 | 1.7 | 15.3 | 0.021 | 182 |
| 51-L | 12 | 9–12 | 2800 | 7.1 | 2.3 | 387 | 2.2 | 16.7 | 0.019 | 172 |
| 52-L | 12 | 9–12 | 3200 | 7.8 | 2.2 | 436 | 2.4 | 15.8 | 0.021 | 165 |
| 53-L | 12 | 9–12 | 3600 | 8.3 | 2.3 | 417 | 2.0 | 17.6 | 0.022 | 157 |
| 54-L | 12 | 9–12 | 4000 | 8.5 | 2.4 | 381 | 2.0 | 19.4 | 0.021 | 145 |
| 5-L | 12 | 9–12 | 4000 | 6.3 | 1.3 | 301 | 2.4 | 11.1 | 0.020 | 107 |
| 56-L | 12 | 9–12 | 4000 | 4.3 | 2.5 | 337 | 2.6 | 29.2 | 0.018 | 74 |
| 57-L | 12 | 9–12 | 4000 | 2.6 | 3.5 | 370 | 4.9 | 33.6 | 0.020 | 45 |

*Grams load at 5% elongation (from stress-strain curves)

Table I

Observation of the results set forth in Table I show that the narrow Molecular Weight Distribution—high Melt Flow resins exhibited a number of improved properties, including low elongation, high birefringence, high tenacity and low spun denier, particularly at high spin speeds above about 1500 meters/minutes. From the properties shown it is clear that the narrow Molecular Weight Distribution—high Melt Flow products of the present invention can be utilized for numerous commercial purposes in their as-spun condition without further treatment or little additional treatment.

Since the largest volumes of samples at the full range of spin speeds and the as-spun physical properties of yarns produced from Resin L approached those of the preferred narrow Molecular Weight Distribution—high Melt flow resins, samples of yarns produced in runs 44 through 57 were cold drawn without twisting to determine whether further treatment would be beneficial. In these tests, the yarns were drawn at a speed of 314 meters/min., with 7 and 6½ wraps about the feed rolls and the draw rolls, respectively, and with temperatures of 80° and 125° C. on the feed rolls and draw rolls, respectively.

The physical properties of the drawn yarns are set forth in Table II below.

TABLE II

| Sample | Max. Draw* | Drawn Tenacity | Elongation | Boiling Water Shrinkage | Modulus 1% | Modulus 5% | Birefringence | Denier |
|---|---|---|---|---|---|---|---|---|
| 44-L | 4.4 | 7.3 | 40 | 3.4 | 55 | 38 | 0.032 | 87 |
| 45-L | 3.7 | 7.4 | 36 | 2.7 | 53 | 43 | 0.033 | 96 |
| 46-L | 3.6 | 8.0 | 38 | 2.1 | 57 | 48 | 0.033 | 83 |
| 47-L | 3.4 | 7.9 | 33 | 2.7 | 63 | 51 | 0.032 | 87 |
| 48-L | 3.1 | 6.8 | 46 | 4.1 | 50 | 44 | 0.032 | 91 |
| 49-L | 2.9 | 6.6 | 68 | 5.9 | 49 | 45 | 0.033 | 80 |
| 50-L | 3.0 | 6.5 | 54 | 3.9 | 51 | 44 | 0.031 | 67 |
| 51-L | 2.6 | 5.5 | 74 | 3.5 | 48 | 38 | 0.032 | 75 |
| 52-L | 2.9 | 6.6 | 59 | 2.6 | 50 | 44 | 0.031 | 64 |
| 53-L | 2.5 | 5.8 | 68 | 2.2 | 44 | 39 | 0.030 | 69 |
| 54-L | 2.6 | 6.3 | 72 | 2.1 | 48 | 44 | 0.031 | 61 |
| 55-L | 2.5 | 6.2 | 56 | 2.2 | 50 | 44 | 0.028 | 46 |
| 56-L | 1.9 | 4.9 | 101 | 1.8 | 50 | 39 | 0.028 | 42 |
| 57-L | 1.9 | 5.0 | 72 | 2.1 | 50 | 39 | 0.028 | 27 |

*Ran 5 min. without break-out by starting at higher ratio and reducing gradually until good running achieved.

It is to be observed that improvement in properties required cold drawing at high draw ratios.

Polymer B was melt spun using a 70 hole 0.020×0.020 inch hole spinnerette and a 360 mesh screen in an effort to make yarn having a total denier of 300. Quench air was 80 ft/min. A finish C was applied to the yarn at a rate of 1% by weight and comprised 86.63% Nopcolube 2152P (Diamond Shamrock, Morristown, N.J.) 13.32% Ethoxylated cetyl/stearyl alcohol (25 moles ethylene oxide per molecule) and 0.05% Givgard DXN. The yarns were also heat set for 5 hours at the temperature indicated. These runs and the physical properties of the yarn are set forth in Table III below.

TABLE III

| Run Sample | Spin Speed m/min. | Heat Set Temp, °F. | Denier | Tenacity | Elongation | Boiling Water Shrinkage | Modulus 1% | Modulus 5% |
|---|---|---|---|---|---|---|---|---|
| 58-B | 3500 | None | 298 | 2.3 | 166 | 14.7 | 17 | 12 |
| 59-B | 3500 | 230 | 300 | 2.3 | 149 | 0.6 | 23 | 15 |
| 60-B | 3500 | 270 | 299 | 1.8 | 115 | 0.9 | 18 | 12 |
| 61-B | 2500 | None | 285 | 1.6 | 230 | 12.5 | 11 | |
| 62-B | 2500 | 230 | 285 | 2.0 | 178 | 0.5 | 19 | 12 |
| 63-B | 2500 | 270 | 80–159 | 2.8 | 121 | 0.9 | 27 | 19 |

Run 63 is rather meaningless since the supply of polymer began to run out at the end of the run. Also problems of lost filaments occurred in the spinning at 3500 m/min. However, the data clearly indicates that heat setting does reduce the elongation and shrinkage significantly. In spite of the spinning problems at 3500 m/min. it can also be seen that the higher speed (3500 m/min.) produces a yarn of higher tenacity and lower elongation than spinning at the lower speed (2500 m/min.).

In order to determine what effect false-twist draw-texturing during spinning would have on products of the present invention, three polypropylenes were run under varying conditions of draw ratio and twist ratios to produce 600, 700, 800 and 900 denier yarns from each polymer. In these runs the polymers were each run on a 34 hole, 0.012×0.048 inch hole spinnerette with a 325 mesh screen. A polymer pressure of 2000 psig, a spinning speed of 800 m/min. and a quench air rate of 80 ft/min. were utilized in all runs. Polymer temperatures (°C.) at each of four extruder zones and the polymer properties were as follows:

| Polymer | MWD | Resin MF | $Z_1$ | $Z_2$ | $Z_3$ | $Z_4$ |
|---|---|---|---|---|---|---|
| C | 5.0 | 21 | 205 | 235 | 250 | 250 |
| M | 5.0 | 34 | 205 | 235 | 250 | 250 |
| N | | 12 | 230 | 250 | 280 | 280 |

0.5% by weight of a finish, herein designated finish B as in Table V, comprising a 10% emulsion of a reactive polysiloxane (Dow Corning 1111 Emulsion, sold by Dow Corning Corp.) was applied to the yarns.

A Scragg, 12 ceramic disc friction texturing machine was utilized, with temperatures of 150° C. at both the first and second heaters. Twist and contraction factor were measured on snatched samples. Overfeed was 12% to the setting zone. Denier was calculated at the draw roll using the formula:

$$\frac{\text{Undrawn Denier}}{\text{Draw Ratio}}$$

The speed of the draw roll was 297 m/min. at D/Y 1.56 and 272 m/min. at D/Y 1.71.

Table IV below sets forth the results of these runs.

TABLE IV

| Sample Resin | SD | $t_1/t_2$ | FD | CF | tpi |
|---|---|---|---|---|---|
| | DR = 2.225 | D/Y = 1.56 | | | |
| 66-N | 600 | 64/95 | 270 | 1.55 | 35 |
| 65-N | 800 | 100/62 | 360 | 1.50 | 24 |
| 66-C | 600 | 25/35 | 270 | 1.53 | 33 |
| 67-C | 700 | 34/45 | 315 | 1.56 | 31 |
| 68-C | 800 | 40/52 | 360 | 1.53 | 28 |
| 69-C | 900 | 43/52 | 404 | 1.57 | 27 |
| 70-M | 600 | 27/37 | 270 | 1.54 | 32 |
| 71-M | 700 | 34/43 | 315 | 1.55 | 30 |
| 72-M | 800 | 42/55 | 360 | 1.49 | 26 |
| 73-M | 900 | 48/58 | 404 | 1.47 | 23 |
| | DR = 2.225 | D/Y = 1.71 | | | |
| 74-N | 600 | 66/36 | 270 | 1.58 | 35 |
| 75-C | 600 | 27/27 | 270 | 1.51 | 34 |
| 76-C | 800 | 40/43 | 360 | 1.46 | 28 |
| 77-M | 600 | 28/25 | 270 | 1.63 | 36 |
| 78-M | 800 | 41/46 | 360 | 1.50 | 27 |
| | DR = 2.407 | D/Y = 1.56 | | | |
| 79-N | 600 | 65/45 | Unable to snatch sample | | |
| 80-C | 600 | 26/40 | 249 | 1.55 | 36 |
| 81-C | 800 | 41/56 | 332 | 1.50 | 29 |
| 82-M | 600 | 31/55 | 249 | 1.45 | 34 |
| 83-M | 800 | 41/59 | 332 | 1.48 | 29 |
| | DR = 2.407 | D/Y = 1.71 | | | |
| 84-N | 600 | 64/44 | 249 | 1.68 | 33 |
| 85-C | 600 | 29/36 | 249 | 1.62 | 35 |
| 86-C | 800 | 42/44 | 332 | 1.50 | 29 |
| 87-M | 600 | 30/38 | 249 | 1.56 | 36 |
| 88-M | 800 | 44/45 | 332 | 1.55 | 31 |
| | DR = 2.622 | D/Y = 1.56 | | | |
| 89-N | 600 | 60/48 | 229 | 1.60 | 38 |
| 90-C | 600 | 28/40 | 229 | 1.63 | 38 |
| 91-C | 800 | 41/55 | 305 | 1.54 | 32 |
| 92-M | 600 | 30/42 | 229 | 1.57 | 39 |
| 93-M | 800 | 43/62 | 305 | 1.54 | 32 |
| | DR = 2.622 | D/Y = 1.71 | | | |
| 94-M | 600 | 31/35 | 229 | 1.55 | 37 |
| 95-M | 800 | 46/51 | 305 | 1.51 | 31 |
| | DR = 2.821 | D/Y = 1.71 | | | |
| 96-M | 600 | 34/41 | 213 | 1.51 | 39 |
| 97-M | 800 | 49/63 | 284 | 1.49 | 33 |
| | DR = 3.023 | D/Y = 1.71 | | | |

TABLE IV-continued

| Sample Resin | SD | $t_1/t_2$ | FD | CF | tpi |
|---|---|---|---|---|---|
| 98-M | 600 | 38/47 | 198 | 1.50 | 41 |
| 99-M | 800 | 48/62 | 265 | 1.46 | 34 |
| | DR = 3.206 | D/Y = 1.71 | | | |
| 100-M | 600 | 39/46 | 187 | 1.53 | 43 |
| 101-M | 800 | 52/65 | 250 | 1.47 | 35 |
| | DR = 3.413 | D/Y = 1.71 | | | |
| 102-M | 600 | 43/57 | 176 | 1.52 | 45 |
| 103-M | 800 | 51/63 | 234 | 1.56 | 38 |

Symbols above represent the following:
DR = Draw ratio
D/Y = Surface speed of discs/linear speed of yarn
SD = Spun Denier
$t_1$ = tension in grams as measured above false twist spindle
$t_2$ = tension in grams as measured below false twist spindle
FD = Denier at draw roll - Undrawn Denier/Draw Ratio
CF = Contraction Factor - untwisted length/twisted length
tpi = turns per inch 600 spun denier yarn of polymer N had broken filaments at a draw ratio of 2.622 and D/Y of 1.56 and would not run at higher draw ratios and D/Y's.

It was concluded during the above runs and from an analysis of the data, increased D/Y decreases $t_2$ but has little effect on twist, the low melt flow polymer did not run well under any conditions as compared with the high melt flow polymers and tpi is a function of denier and is little affected by draw ratios, D/Y and tension.

Based on the good performance attained in the previous tests, polymer M was false-twist, draw-textured in a variety of colors to produce 250 denier through the 34-hole spinnerette. All samples were spun at 800 as-spun denier and at 800 m/minute. Draw-texturing conditions were at a draw ratio of 3.413, D/Y of 1.71, 272 m/min., heater temperatures of 150° C. and an overfeed across the second heater (to setting zone) of 12%. Two different finishes, namely, the previously described finishes B and C, were applied in some runs.

Table V lists the as-spun properties.

TABLE V

| Run-Polymer | Color | Finish | Denier | Tenacity | Elongation |
|---|---|---|---|---|---|
| 104-M | Natural | C | 798 | 1.4 | 504 |
| 105-F | Natural | C | 807 | 1.1 | 615 |
| 106-M | White | C | 804 | 1.4 | 541 |
| 107-M | White | B | 804 | 1.4 | 541 |
| 108-M | Lemon | C | 803 | 1.3 | 587 |
| 109-M | Gold Leaf | C | 812 | 1.0 | 745 |
| 110-M | Gold Leaf | B | 812 | 1.0 | 745 |
| 111-M | Blaze Red | C | 807 | 1.0 | 717 |
| 112-M | Spice Brown | C | 813 | 1.0 | 710 |
| 113-M | Spice Brown | B | 813 | 1.0 | 710 |
| 114-M | Velvet | C | 821 | 1.1 | 906 |
| 115-M | Black | C | 814 | 1.2 | 609 |
| 116-M | Black | B | 814 | 1.2 | 609 |

The properties of the finished yarns after draw-texturing are set forth in Table VI.

TABLE VI

| Run-Polymer | Color | Finish | t1/t2 | CF | tpi |
|---|---|---|---|---|---|
| 104-M | Natural | C | 52/70 | 1.49 | 36 |
| 105-F | Natural | C | 37/50 | 1.50 | 37 |
| 106-M | White | C | 39/48 | 1.54 | 39 |
| 107-M | White | B | 44/30 | 1.54 | 39 |
| 108-M | Lemon | C | 37/34 | 1.52 | 38 |
| 109-M | Gold Leaf | C | 30/30 | 1.55 | 37 |
| 110-M | Gold Leaf | B | 30/28 | 1.61 | 40 |
| 111-M | Blaze Red | C | 29/22 | 1.60 | 38 |
| 112-M | Spice Brown | C | 30/17 | 1.58 | 40 |
| 113-M | Spice Brown | B | 32/28 | —* | —* |
| 114-M | Velvet | C | 30/17 | 1.58 | 39 |

TABLE VI-continued

| Run-Polymer | Color | Finish | t1/t2 | CF | tpi |
|---|---|---|---|---|---|
| 115-M | Black | C | 35/22 | 1.52 | 40 |
| 116-M | Black | B | 38/26 | 1.51 | 40 |

*Yarn broke out

All samples in the above test spun without incident. However, the yarns to which finish B was applied fused during texturing and the yarn of run 113 broke out in attempting to snatch.

In order to prepare 3-ply yarns the spinning and false-twist draw-texturing of the previous runs were repeated except for those instances where finish B had been utilized. Operation of an entangler of the type referred to in FIG. 3 was tried but found to produce too much entanglement. Thereafter, an interlacer of the type specifically referred to in the discussion of FIG. 11 was used with each position of the disc type false-twisters all rotating in the same direction but the composite yarn produced was of high torque. Finally, the last mentioned interlacer was used with the false-twist positions alternating direction of twist and the air to the interlacer or entangling jet at 30 psi. Two composite yarns of three yarns each in accordance with the method described with reference to FIG. 11. This procedure eliminates the excess torque and produced acceptable composite yarns.

Table VII sets forth the properties of the individual yarns and the two composite yarns.

TABLE VII

| Run Polymer | Color | Denier | Tenacity | Elongation | LSS* |
|---|---|---|---|---|---|
| 117-M | Natural | 255 | 4.0 | 31 | 9.8 |
| 118-F | Natural | 261 | 3.0 | 38 | 13.3 |
| 119-M | White | 243 | 4.4 | 44 | 12.5 |
| 120-M | Lemon | 252 | 3.9 | 46 | 13.8 |
| 121-M | Gold Leaf | 255 | 2.8 | 63 | 9.6 |
| 122-M | Blaze Red | 251 | 3.0 | 73 | 12.0 |
| 123-M | Spice Brown | 248 | 2.3 | 27 | 9.6 |
| 124-M | Velvet Brown | 252 | 2.9 | 31 | 13.6 |
| 125-M | Black | 254 | 3.8 | 60 | 14.4 |
| 126 | Composite 121-122-125 | 792 | 2.9 | 65 | 5.9 |
| 127 | Composite 120-124-123 | 786 | 3.1 | 45 | 2.4 |

*LSS is the Leesona Skein Shrinkage Test

It was determined from the above data that the entangling procedure utilized herein (entangling during spinning and prior to windup) also increased the denier above what would theoretically be expected by a conventional entangling procedure (entangling individual yarns after windup). It should be recognized that as many as 6 to 8 yarns could be similarly interlaced to produce composite yarns of 1500 to 2000 denier.

The composite yarns were also knit and woven into fabrics without difficulty. The knit sample was boiled off and developed good bulk and pleasing hand. The composite yarns could be used in hand knit items, upholstery fabrics, etc.

This test was carried out to evaluate the Taslan texturing of yarns produced in accordance with the present invention which have been twisted but not drawn. Polymer B was spun at 2500 m/min. and in the same manner and under the same conditions as the previous example except that it was wound at 40 grams tension. The yarn was twisted on a Single Spindle Dienes Twister at 465 m/min., and 5500 rpm spindle speed to produce 0.3 twist level. The properties of the untwisted and twisted yarns are set forth in Table VIII below.

TABLE VIII

| Run-Polymer | Condition | Denier | Tenacity | Elon-gation | Shrink-age |
|---|---|---|---|---|---|
| 128 B | Untwisted | 312 | 2.0 | 284 | 8.9 |
| B | 0.3 Twist | 303 | 1.9 | 246 | 9.3 |

This yarn, a twist-drawn yarn from polymer A and a core yarn from polymer A were Taslan textured at a core feed rate of 187 m/min., an effective feed rate of 337 m/min. and a take-up speed of 182 m/min. The yarn was also run side-by-side with a commercial yarn with the speed being the maximum to get acceptable bonding with the core in the commercial yarn. Inspection of the yarns indicated that the yarn of the present invention tangled with the core yarn better than the commercial yarn.

in order to evaluate draw-Taslan texturing of the yarns of the present invention a series of runs were made comparing yarns prepared from Polymer C and from Polymer N at different spin speeds and in different colors. A 34-hole, round, 0.015×0.019 inch spinnerette was used. Spinning temperatures (°C.) were 250° C. for polymer C and 292° C. for polymer N.

The quench air rate was <80 ft/min. and 1.1% by weight of finish B was applied. Table IX below sets forth the as-spun deniers obtained.

TABLE IX

| Run-Polymer | Color | Spin Speed | Denier |
|---|---|---|---|
| 129 C | Blue | 800 | 464 |
| 130 C | Blue | 800 | 399 |
| 131 C | Blue | 1100 | 404 |
| 132 C | Blue | 1100 | 349 |
| 133 C | Blue | 1500 | 351 |
| 134 C | Blue | 1500 | 301 |
| 135 C | Blue | 2200 | 252 |
| 136 N | Blue | 800 | 460 |
| 137 N | Blue | 800 | 400 |
| 138 N | Blue | 1100 | 402 |
| 139 N | Blue | 1100 | 348 |
| 140 N | Blue | 1500 | 352 |
| 141 N | Blue | 1500 | 303 |
| 142 N | Blue | 2200 | 248 |
| 143 C | Brown | 800 | 460 |
| 144 C | Brown | 800 | 401 |
| 145 C | Brown | 1100 | 409 |
| 146 C | Brown | 1100 | 350 |
| 147 C | Brown | 1500 | 352 |
| 148 C | Brown | 1500 | 300 |
| 149 C | Brown | 2200 | 252 |

Samples of Polymer C spun well at all speeds but difficulties were encountered in quenching Polymer N at 1500 and 2200 m/min. due to the presence of wild filaments.

The yarns produced were then drawn on the apparatus of FIG. 2 under varied heat conditions during draw, namely, utilizing heated draw rolls, cold draw rolls and a hot 10-inch plate operating at either 140° C. or 120° C., and cold draw rolls with no heating of any type. Drawing was conducted at a speed of 800 m/min. and with 7 and 6½ wraps around the feed rolls and draw rolls, respectively. Table X sets forth the properties of the yarns produced.

TABLE X

| Run Polymer | Draw Condition | Draw Ratio | Draw Tension | Drawn Denier | Actual Draw | Hunter D-25 Colorimeter L | a | b | ∇L | ∇a | ∇b | ∇E |
|---|---|---|---|---|---|---|---|---|---|---|---|---|
| 129-C | hot rolls | 3.53 | 165 | 132 | 1.00 | 25.7 | +5.0 | −21.9 | | | | |
| | plate 140° | 3.53 | 160 | 136 | 0.97 | | | | +0.4 | −0.4 | −0.8 | 1.0 |
| | plate 120° | 3.53 | 165 | 137 | 0.96 | | | | +0.3 | −0.4 | −0.9 | 1.1 |
| | cold | 3.53 | 200 | 138 | 0.95 | | | | +0.8 | −0.9 | −0.7 | 1.4 |
| 130-C | hot rolls | 3.07 | 135 | 126 | 1.03 | 25.8 | +5.4 | −23.0 | | | | |
| | plate 140° | 3.07 | 135 | 133 | 0.98 | | | | +0.1 | −0.1 | −0.6 | 0.6 |
| | plate 120° | 3.07 | 140 | 134 | 0.97 | | | | +0.3 | −0.4 | −0.4 | 0.6 |
| | cold | 3.07 | 180 | 135 | 0.86 | | | | +0.5 | −1.1 | +0.1 | 1.3 |
| 131-C | hot rolls | 3.07 | 170 | 133 | 0.99 | 26.4 | +3.4 | −21.2 | | | | |
| | plate 140° | 3.07 | 165 | 138 | 0.95 | | | | +0.1 | −0.3 | −0.9 | 0.9 |
| | plate 120° | 3.07 | 180 | 138 | 0.95 | | | | 0 | −0.4 | −0.7 | 0.8 |
| | cold | 3.07 | 205 | 142 | 0.93 | | | | +0.7 | −1.1 | 0 | 1.4 |
| 132-C | hot rolls | 2.69 | 135 | 127 | 1.02 | 26.3 | +3.4 | −21.1 | | | | |
| | plate 140° | 2.69 | 130 | 135 | 0.96 | | | | +0.2 | −0.3 | −0.6 | 0.6 |
| | plate 120° | 2.69 | 145 | 135 | 0.96 | | | | +0.3 | −0.3 | −0.7 | 0.8 |
| | cold | 2.69 | 195 | 127 | 0.95 | | | | +0.7 | −0.9 | −0.4 | 1.3 |
| 133-C | hot rolls | 2.69 | 180 | 133 | 0.98 | 26.3 | +3.7 | −21.2 | | | | |
| | plate 140° | 2.69 | 180 | 139 | 0.94 | | | | −0.2 | −0.2 | −0.7 | 0.8 |
| | plate 120° | 2.69 | 190 | 139 | 0.94 | | | | 0 | −0.6 | −0.7 | 1.0 |
| | cold | 2.69 | 220 | 143 | 0.91 | | | | +0.2 | −1.1 | −0.2 | 1.2 |
| 134-C | hot rolls | 2.30 | 145 | 130 | 1.01 | 25.9 | +3.9 | −21.1 | | | | |
| | plate 140° | 2.30 | 150 | 136 | 0.96 | | | | +0.7 | −0.6 | −0.7 | 1.1 |
| | plate 120° | 2.30 | 155 | 132 | 0.96 | | | | +0.2 | −0.6 | −0.9 | 1.1 |
| | cold | 2.30 | 215 | 140 | 0.94 | | | | +0.6 | −1.1 | −0.2 | 1.3 |
| 135-C | hot rolls | 1.92 | 180 | 135 | 0.97 | 25.7 | +4.0 | −21.1 | | | | |
| | plate 140° | 1.92 | 175 | 138 | 0.95 | | | | +0.4 | −0.3 | −0.3 | 0.5 |
| | plate 120° | 1.92 | 195 | 145 | 0.91 | | | | +3.3 | −0.9 | −3.1 | 4.6 |
| | cold | 1.92 | 235 | 143 | 0.92 | | | | +0.4 | −1.0 | +0.4 | 1.2 |
| 136-N | hot rolls | 3.53 | 210 | 141 | 0.93 | 27.5 | +1.4 | −21.0 | | | | |
| | plate 140° | 3.53 | 210 | 146 | 0.92 | | | | +0.4 | −0.3 | −0.7 | 1.0 |
| | plate 120° | 3.53 | 250 | 144 | 0.91 | | | | +0.6 | −0.4 | −0.7 | 1.1 |
| | cold | 3.53 | 240* | 149 | 0.88 | | | | +0.9 | −0.4 | −0.8 | 1.3 |
| 137-N | hot rolls | 3.07 | 185 | 140 | 0.93 | 27.5 | +1.4 | −21.3 | | | | |
| | plate 140° | 3.07 | 195 | 142 | 0.92 | | | | +0.5 | −0.4 | −0.5 | 0.9 |
| | plate 120° | 3.07 | 220 | 141 | 0.92 | | | | +0.5 | −0.4 | −0.5 | 0.9 |
| | cold | 3.07 | 220 | 146 | 0.89 | | | | +1.4 | −0.6 | −0.8 | 1.8 |
| 138-N | hot rolls | 3.07 | 220 | 140 | 0.94 | 27.4 | +1.7 | −20.6 | | | | |
| | plate 140° | 3.07 | 230 | 150 | 0.87 | | | | +1.2 | −0.3 | −2.1 | 2.5 |

TABLE X-continued

| Run Polymer | Draw Condition | Draw Ratio | Draw Tension | Drawn Denier | Actual Draw | Hunter D-25 Colorimeter L | a | b | ∇L | ∇a | ∇b | ∇E |
|---|---|---|---|---|---|---|---|---|---|---|---|---|
| | plate 120° | 3.07 | 240* | 150 | 0.87 | | | | +1.9 | −0.4 | −2.3 | 3.0 |
| | cold | 3.07 | 280* | 144 | 0.91 | | | | +2.5 | −0.3 | −3.1 | 4.0 |
| 139-N | hot rolls | 2.69 | 195 | 138 | 0.94 | 27.1 | +1.7 | −20.8 | | | | |
| | plate 140° | 2.69 | 200 | 142 | 0.91 | | | | +1.9 | −0.4 | −2.1 | 2.9 |
| | plate 120° | 2.69 | 225 | 144 | 0.90 | | | | +1.9 | −0.5 | −2.1 | 2.9 |
| | cold | 2.69 | 250* | 150 | 0.87 | | | | +1.7 | 0 | −3.0 | 3.5 |
| 140-N | hot rolls | 2.69 | 210 | 147 | 0.89 | 27.9 | +1.8 | −20.5 | | | | |
| | plate 140° | 2.69 | 210 | 150 | 0.87 | | | | +2.2 | +0.2 | −4.3 | 4.8 |
| | plate 120° | 2.69 | 210* | 144 | 0.91 | | | | +2.1 | +0.2 | −4.3 | 4.7 |
| | cold | 2.69 | 270* | 152 | 0.86 | | | | +3.1 | +0.6 | −4.6 | 5.5 |
| 141-N | hot rolls | 2.30 | 195 | 139 | 0.95 | 28.0 | +1.5 | −20.3 | | | | |
| | plate 140° | 2.30 | 200 | 145 | 0.91 | | | | +2.1 | +0.4 | −4.2 | 4.7 |
| | plate 120° | 2.30 | 205 | 155 | 0.85 | | | | +2.2 | +0.4 | −4.4 | 4.9 |
| | cold | 2.30 | 260 | 156 | 0.84 | | | | +2.0 | +0.7 | −4.6 | 5.0 |
| 142-N | hot rolls | 1.92 | 190 | 144 | 0.90 | 28.4 | +1.8 | −20.9 | | | | |
| | plate 140° | 1.92 | 190 | 150 | 0.86 | | | | +1.4 | +0.5 | −3.1 | 3.4 |
| | plate 120° | 1.92 | 195 | 149 | 0.87 | | | | +1.0 | +0.7 | −2.7 | 2.8 |
| | cold | 1.92 | 260* | 152 | 0.85 | | | | −0.5 | +0.7 | −0.3 | 0.8 |
| 143-N | hot rolls | 3.53 | 160 | 132 | 0.99 | 24.6 | +6.2 | +8.0 | | | | |
| | plate 140° | 3.53 | 160 | 136 | 0.96 | | | | +1.2 | +0.5 | +0.9 | 1.5 |
| | plate 120° | 3.53 | 165 | 137 | 0.95 | | | | +2.2 | +0.2 | +1.0 | 2.5 |
| | cold | 3.53 | 215 | 140 | 0.93 | | | | +3.4 | +0.2 | +1.1 | 3.6 |
| 144-N | hot rolls | 3.07 | 130 | 128 | 1.01 | 25.6 | +4.8 | +8.8 | | | | |
| | plate 140° | 3.07 | 135 | 135 | 0.96 | | | | −0.6 | +0.7 | +0.4 | 0.9 |
| | plate 120° | 3.07 | 145 | 135 | 0.96 | | | | +0.5 | +0.5 | +0.6 | 0.8 |
| | cold | 3.07 | 180 | 138 | 0.94 | | | | +1.8 | +0.4 | +0.7 | 2.0 |
| 145-N | hot rolls | 3.07 | 165 | 134 | 0.97 | 24.7 | +4.9 | +8.4 | | | | |
| | plate 140° | 3.07 | 160 | 138 | 0.95 | | | | +1.4 | +0.3 | +0.7 | 1.6 |
| | plate 120° | 3.07 | 170 | 140 | 0.93 | | | | +1.2 | +0.4 | +0.7 | 1.5 |
| | cold | 3.07 | 200 | 143 | 0.91 | | | | +2.4 | +0.3 | +0.9 | 2.6 |
| 146-N | hot rolls | 2.69 | 130 | 129 | 1.01 | 24.6 | +5.2 | +8.7 | | | | |
| | plate 140° | 2.69 | 135 | 135 | 0.96 | | | | +1.1 | +0.1 | +0.4 | 1.2 |
| | plate 120° | 2.69 | 135 | 137 | 0.95 | | | | +0.3 | +0.2 | +0.3 | 0.3 |
| | cold | 2.69 | 180 | 138 | 0.94 | | | | +1.9 | +0.2 | +0.4 | 2.0 |
| 147-N | hot rolls | 2.69 | 170 | 135 | 0.97 | 23.9 | +5.2 | +8.2 | | | | |
| | plate 140° | 2.69 | 165 | 139 | 0.94 | | | | +1.9 | +0.3 | +0.6 | 2.0 |
| | plate 120° | 2.69 | 185 | 139 | 0.94 | | | | +1.1 | +0.2 | +0.6 | 1.3 |
| | cold | 2.69 | 21 | 143 | 0.92 | | | | +2.5 | +0.2 | +0.7 | 2.7 |
| 148-N | hot rolls | 2.30 | 135 | 131 | 1.00 | 24.2 | +4.8 | +8.4 | | | | |
| | plate 140° | 2.30 | 135 | 135 | 0.97 | | | | +0.8 | +0.3 | +0.5 | 1.0 |
| | plate 120° | 2.30 | 150 | 137 | 0.95 | | | | +0.6 | +0.3 | +0.5 | 0.8 |
| | cold | 2.30 | 195 | 139 | 0.97 | | | | +1.7 | +0.3 | +0.7 | 1.9 |
| 149-N | hot rolls | 1.92 | 165 | 131 | 1.00 | 24.2 | +4.8 | +8.4 | | | | |
| | plate 140° | 1.92 | 155 | 136 | 0.96 | | | | +0.4 | +0.3 | +0.4 | 0.6 |
| | plate 120° | 1.92 | 165 | 138 | 0.95 | | | | +0.5 | +0.3 | +0.4 | 0.5 |
| | cold | 1.92 | 220 | 143 | 0.91 | | | | +1.0 | +0.3 | +0.4 | 1.1 |

*In run 136 it was necessary to draw at 400 m/m with no heating; broken filaments were observed in run 137 with no heating; broken filaments occurred in run 138 with the plate at 140° and it was necessary to draw at 400 and 100 m/min. with the plate at 120° and no heating, respectively, because of broken filament; in run 139, broken filaments were observed with the heated plate at 140° and 120° and broken filament occurred while drawing at 400 m/min. without heating; in run 140 broken filaments occurred with the plate at 1400 but ran well with the plate at 120 with drawing a 400 m/m while broken filaments were observed with no heating and drawing at 100 m/min; broken filaments were observed in run 141 without heating; and, in run 142, broken filaments occurred without heating and drawing had to be carried out at 200 m/min.

It is clear, from the results set forth in Table X that the drawing efficiency (lack of broken filaments, etc.) is much better for the narrow molecular weight distribution Polymer C than for the broad molecular weight distribution (conventional) Polymer N, both with the heated plate and with no heating. The actual draw was also higher for Polymer C than for Polymer N and increased as draw tension decreased. The color data shows a greater color effect on Polymer N, when it is cold drawn, than on Polymer C. The hot plate and lower draw tensions appear to improve the color differences of Polymer C samples. The unusual result (low WE) observed in run 142 when the sample of Polymer N spun at 2200 m/min. was cold drawn resulted from the sample continuing to shrink after windup. In general, the low WL values with cold draw indicate that light color results, but this can be remedied by color adjustments. Analysis of the above runs lead to the conclusion that Polymer C can be cold drawn (with a hot plate) during spinning at 1400 to 1800 m/min. and at full extruder output (380#/hr) with only minimal color adjustment.

While specific examples and items of equipment have been set forth herein, it is to be understood that such recitations are illustrative only and are not to be limiting.

I claim:

1. A process for making a filament yarn comprising; melt spinning a polypropylene resin having a molecular weight distribution of less than about 7 and a resin melt flow between about 20 and about 60, applying a finish and taking up the filament yarn at a speed of at least about 800 meters per minute.

2. A process according to claim 1 wherein the filament yarn is taken up at a speed of at least about 1200 meters per minute.

3. A process according to claim 1 wherein the filament yarn is taken up at a speed between about 800 and about 1200 meters per minute.

4. A polypropylene filament yarn product melt spun from a polypropylene resin having a molecular weight distribution of less than about 7 and a melt flow between about 20 and about 60, said filaments having a finish applied thereto and said filaments having been taken up at a speed of at least about 800 meters per minute.

5. A product according to claim 4 wherein the filaments have been taken up at a speed of at least about 1200 meters per minute.

6. A product according to claim 4 wherein the filaments have been taken up at a speed between about 800 and about 1200 meters per minute.

7. A polypropylene filament yarn product melt spun from a polypropylene having a molecular weight distribution of less than about 7 and a melt flow between about 20 and about 60, said filaments having a birefringence above about 0.15, a tenacity above about 2.4 grams per denier, an elongation between about 100% and about 300% and a denier per filament of less than about 25.

8. A process for making filament yarn comprising: melt spinning a polypropylene resin having a molecular weight distribution of less than about 7 and a resin melt flow between about 20 and about 60, applying a finish, taking up the filament yarn at a speed of at least about 800 meters per minute and treating the filament yarn to improve the bulkiness thereof.

9. A process according to claim 8 wherein the filament yarn is taken up at a speed of at least about 1200 meters per minute.

10. A process according to claim 1 wherein the filament yarn is taken up at a speed between about 800 and about 1200 meters per minute.

11. A method in accordance with claim 10 wherein the bulkiness of the filament yarn is improved by simultaneously draw-false twist texturing while reversing the direction of twist of alternate yarns and plying the yarns in an interlacing jet.

12. A process according to claim 11 wherein the simultaneous draw-false twist texturing is carried out at a draw ratio between about 2 to 1 and about 4 to 1.

13. A process according to claim 8 or 9 wherein the bulkiness of the filament yarn is improved by sequentially draw-texturing.

14. A process according to claim 13 wherein the draw-texturing is draw-disc texturing.

15. A process according to claim 13 wherein the draw-texturing is draw-jet texturing.

16. A process according to claim 15 wherein the jet is directed in the general direction of travel of the yarn.

17. A process according to claim 15 wherein the jet is directed at an angle of about 90° to the yarn.

18. A method according to claim 8 or 9 wherein the bulkiness of the yarn is improved by simultaneously draw-texturing.

19. A process according to claim 18 wherein the draw-texturing is draw-false twist texturing.

20. A process according to claim 8 or 9 wherein the bulkiness of the yarn is improved by crimping.

21. A propylene filament yarn product melt spun from a polypropylene having a molecular weight distribution of less than about 7 and a melt flow between about 20 and about 60, said filaments having a finish applied thereto, said filaments having been taken up at a speed of at least about 800 meters per minute and said filaments having been treated to improve the bulkiness thereof.

22. A product according to claim 21 wherein the filaments have been taken up at a speed of at least about 1200 meters per minute.

23. A product according to claim 21 wherein the filaments have been taken up at a speed between about 800 and about 1200 meters per minute.

24. A product according to claim 23 wherein the bulkiness of the yarn has been improved by simultaneously draw-false twist texturing while reversing the direction of twist of alternate yarns and plying the yarns in an interlacing jet.

25. A product according to claim 24 wherein the draw-false twist texturing has been carried out at a draw ratio between about 2 to 1 and about 4 to 1.

26. A polypropylene filament yarn product melt spun from a polypropylene having a molecular weight distribution of less than about 7 and a melt flow between about 20 and about 60, the as-spun filaments having a birefringence above about 0.15, a tenacity above about 2.4 grams per denier, an elongation between about 100% and about 350% and a denier per filament of less than about 25 and said filaments having been treated to improve the bulkiness thereof.

27. A product according to claim 50 wherein the bulkiness of the yarn has been improved by sequentially draw-texturing.

28. A product according to claim 27 wherein the draw-texturing is draw-disc texturing.

29. A product according to claim 27 wherein the draw-texturing is a draw-jet texturing.

30. A product according to claim 29 wherein the jet is directed in the general direction of travel of the yarn.

31. A product according to claim 29 wherein the jet is directed at an angle of about 90° to the yarn.

32. A product according to claim 26 wherein the bulkiness of the yarn is improved by simultaneously draw-texturing.

33. A product according to claim 32 wherein the draw-texturing is draw-false twist texturing.

34. A product according to claim 26 wherein the bulkiness of the yarn is improved by crimping.

35. A process for making filament yarn comprising melt spinning a polypropylene resin having a molecular weight distribution of less than about 7 and a resin melt flow between about 20 and about 60, applying a finish, taking up the filament yarn at a speed of at least about 800 meters per minute and treating the filament yarn to improve the coherency thereof.

36. A process according to claim 35 wherein the filament yarn is taken up at a speed of at least about 1200 meters per minute.

37. A process according to claim 35 wherein the filament yarn is taken up at a speed between about 800 and about 1200 meters per minute.

38. A process according to claim 35 or 36 wherein the coherency of the filament yarn is improved by heat setting.

39. A process according to claim 35 or 36 wherein the coherency of the filament yarn is improved by entangling.

40. A process according to claim 35 or 36 wherein the coherency of the filament yarn is improved by heat setting and entangling.

41. A process according to claim 35 or 36 wherein the coherency of the filament yarn is improved by interlacing.

42. A process according to claim 35 or 36 wherein the coherency of the filament yarn is improved by twist-drawing.

43. A process according to claim 35 or 36 wherein the coherency of the filament yarn is improved by draw-twisting.

44. A polypropylene filament yarn product melt spun from a polypropylene having a molecular weight distribution of less than about 7 and a melt flow between about 20 and about 60, said filaments having a finish applied thereto, said filaments having been taken up at a speed of at least about 800 meters per minute and said filament yarn having been treated to improve the coherency thereof.

45. A product according to claim 44 wherein the filaments have been taken up at a speed of at least about 1200 meters per minute.

46. A product according to claim 44 wherein the filaments have been taken up at a speed between about 800 and about 1200 meters per minute.

47. A polypropylene filament yarn product melt spun from a polypropylene having a molecular weight distribution less than about 7 and a melt flow between about 20 and about 60, the as-spun filaments having a birefringence above about 0.15, a tenacity above about 2.4 grams per denier, an elongation between about 100% and about 350% and a denier per filament of less than about 25 and said filamentary yarn having been treated to improve the coherency thereof.

48. A product according to claim 47 wherein the coherency of the filament yarn has been improved by heat setting.

49. A product according to claim 47 wherein the coherency of the filament yarn has been improved by entangling.

50. A product according to claim 47 wherein the coherency of the filament yarn has been improved by heat setting and entangling.

51. A product according to claim 47 wherein the coherency of the filament yarn has been improved by interlacing.

52. A product according to claim 47 wherein the coherency of the filament yarn has been improved by twist-drawing.

53. A product according to claim 47 wherein the coherency of the filament yarn has been improved by draw-twisting.

* * * * *